US011499451B2

(12) United States Patent
Burge et al.

(10) Patent No.: US 11,499,451 B2
(45) Date of Patent: Nov. 15, 2022

(54) VALVE SPRING RETAINER INCORPORATING LUBRICATION OIL TRAP

(71) Applicant: Cummins Power Generation Limited, Ramsgate (GB)

(72) Inventors: Simon Anthony Burge, Rugby (GB); Alex Edward Priestley, Rugby (GB); Jordan B. Pitcher, Columbus, IN (US)

(73) Assignee: Cummins Power Generation Limited, Ramsgate (GB)

( * ) Notice: Subject to any disclaimer, the term of this patent is extended or adjusted under 35 U.S.C. 154(b) by 0 days.

(21) Appl. No.: 17/527,815

(22) Filed: Nov. 16, 2021

(65) Prior Publication Data

US 2022/0154605 A1 May 19, 2022

(30) Foreign Application Priority Data

Nov. 17, 2020 (GB) ..... 2018089

(51) Int. Cl.
*F01L 3/10* (2006.01)
*F01L 1/46* (2006.01)
(Continued)

(52) U.S. Cl.
CPC ..... *F01L 3/10* (2013.01); *F01L 1/462* (2013.01); *F01M 9/106* (2013.01); *F01L 3/08* (2013.01); *F01L 2810/02* (2013.01); *F01M 9/103* (2013.01)

(58) Field of Classification Search
CPC ..... F01L 1/462; F01L 3/08; F01L 3/10; F01L 2810/02; F01M 9/103; F01M 9/106
(Continued)

(56) References Cited

U.S. PATENT DOCUMENTS 2,633,111 A 3/1953 Pielstick
4,321,894 A * 3/1982 Black ..... F01L 3/10 123/188.17
(Continued)

FOREIGN PATENT DOCUMENTS

JP 2006-063955 3/2006
JP 2006063955 A * 3/2006
(Continued)

OTHER PUBLICATIONS

Search Report on GB Application No. 2018089.9, dated Mar. 22, 2021, 1 page.
(Continued)

*Primary Examiner* — Jorge L Leon, Jr.
(74) *Attorney, Agent, or Firm* — Foley & Lardner LLP

(57) ABSTRACT

A valve spring retainer for an internal combustion engine includes a body having a lower portion and an upper portion. The lower portion defines a radial flange and a first opening extending axially therethrough. The upper portion includes a first wall and a re-entrant lip. The first wall extends at least partially axially away from an outer perimeter edge of the radial flange. Together, the first wall and the radial flange define an open reservoir for receiving and retaining oil therein. The re-entrant lip extends from an outer end of the first wall at least partially radially inward toward a central axis of the first opening. The re-entrant lip extends over a portion of the reservoir defined by the first wall and the radial flange.

20 Claims, 8 Drawing Sheets

(51) Int. Cl.
*F01M 9/10* (2006.01)
*F01L 3/08* (2006.01)

(58) Field of Classification Search
USPC ..... 123/90.67
See application file for complete search history.

(56) References Cited

U.S. PATENT DOCUMENTS

| | | | |
|---|---|---|---|
| 5,873,563 | A | 2/1999 | Hoving, III |
| 2019/0234252 | A1 | 8/2019 | Lauer |

FOREIGN PATENT DOCUMENTS

| | | | | |
|---|---|---|---|---|
| JP | 2008-267296 | | | 11/2008 |
| JP | 2008267296 | A | * | 11/2008 |

OTHER PUBLICATIONS

International Search Report and Written Opinion in PCT/IB2021/060625 dated Feb. 9, 2022 (13 pages).

* cited by examiner

VALVE SPRING RETAINER INCORPORATING LUBRICATION OIL TRAP

CROSS-REFERENCE TO RELATED PATENT APPLICATIONS

The present application claims the benefit of and priority to United Kingdom Patent Application No. 2018089.9, filed Nov. 17, 2020, the entire disclosure of which is hereby incorporated by reference herein.

TECHNICAL FIELD

The present disclosure relates generally to lubrication devices and methods for internal combustion engine systems.

BACKGROUND

Internal combustion engine systems include intake and exhaust valves for directing the flow of fresh air and combustion gases into and out of the combustion cylinder. The valves are generally located in a cylinder head of the engine, above the combustion cylinder and within an enclosed space between the top of the engine block and the valve cover. The valves engage with a rocker arm extending from a camshaft of the internal combustion engine system, which controls actuation of the valves.

SUMMARY

In some systems, a rocker arm also delivers lubricant to the valves to reduce friction and wear and prevent seizure of the valve springs, seals, and other moving components. The lubricant is released from the rocker arm at low pressure, and is distributed by movement of the valves during engine operation. However, the relative position of the valves within the enclosed space can cause an uneven distribution of lubricant, which may starve some valves of lubricant at engine start-up and during prolonged periods of engine operation at low speed or idle.

One embodiment of the present disclosure relates to a valve spring retainer. The valve spring retainer includes a body having a lower portion and an upper portion. The lower portion defines a radial flange and a first opening extending axially therethrough. The upper portion includes a first wall and a re-entrant lip. The first wall extends at least partially axially away from an outer perimeter edge of the radial flange. Together, the first wall and the radial flange define an open reservoir for receiving and retaining oil therein. The re-entrant lip extends from an outer end of the first wall at least partially radially inward toward a central axis of the first opening. The re-entrant lip extends over a portion of the reservoir defined by the first wall and the radial flange.

Another embodiment of the present disclosure relates to valve assembly. The valve assembly includes a valve, a valve spring, and a retainer. The valve includes a valve head and a valve stem extending away from the valve head. The valve spring is disposed over the valve stem. The retainer is coupled to the valve stem and is engaged with an end of the valve spring. The retainer defines a reservoir. An open end of the reservoir faces away from the valve spring. The retainer includes a re-entrant lip that covers a portion of the reservoir. In some embodiments, the valve assembly also includes a pair of collets and a valve guide. The pair of collets is disposed between the retainer and the valve stem and engages the retainer with the valve stem. The valve guide is disposed over the valve stem and slidably engaged with the valve stem.

Yet another embodiment of the present disclosure relates to an engine. The engine includes a cylinder block having a plurality of cylinders and a valve assembly. The valve assembly includes a valve, a valve spring, and a retainer. The valve is structured to control the delivery of fresh air into a cylinder of the plurality of cylinders. The valve spring at least partially surrounds the valve. The retainer couples the valve spring to the valve and defines a reservoir having an open end that faces away from the valve spring. The retainer includes a re-entrant lip that covers a portion of the reservoir.

It should be appreciated that all combinations of the foregoing concepts and additional concepts discussed in greater detail below are contemplated as being part of the subject matter disclosed herein. In particular, all combinations of claimed subject matter appended at the end of this disclosure are contemplated as being part of the subject matter disclosed herein.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

Figure 1:
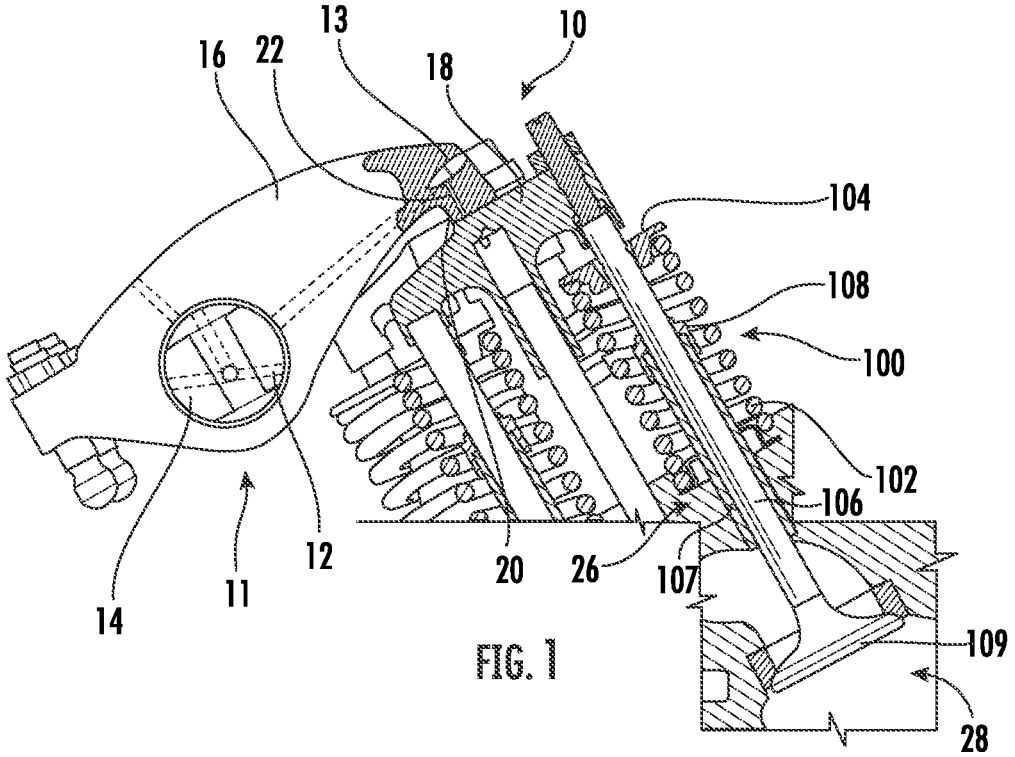
FIG. 1 is a partial view of an overhead valve arrangement for an internal combustion engine system, according to an embodiment.

Reference is made to the accompanying drawings throughout the following detailed description. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

DETAILED DESCRIPTION

Embodiments described herein relate generally to methods and devices for lubricating intake/exhaust valve assemblies for internal combustion engine systems. In particular, embodiments described herein relate generally to a valve spring retainer for capturing lubricant (e.g., lubricating oil) during engine operation, retaining oil after the engine is powered off, and redistributing oil to the valve assembly at engine startup and during operation.

In various traditional internal combustion engine systems, a valve train is provided to control the flow of fresh air and combustion gases into and out of the combustion cylinder (e.g., chamber, etc.). The valve train includes multiple valve assemblies, which are continuously lubricated to ensure proper operation and to increase their operational life. Oil is distributed to each valve assembly through a rocker arm that engages and controls actuation of the valve assembly. As shown in the valve arrangement 10 of FIG. 1, oil is introduced into an enclosed space defined by a valve cover or rocker housing (not shown), in between the valve cover and the engine block. Oil enters the enclosed space through an oil feed system 11 that includes a rocker shaft 14, a rocker arm 16 (e.g., lever, etc.), and a crosshead 18. The rocker arm 16 is driven by a camshaft and oscillates about the rocker shaft 14 at high speed, in order to open and close the valve assemblies 100 during engine operation. As shown in FIG. 1, a first end of the rocker arm 16 is disposed proximate to the camshaft, and a second opposing end of the rocker arm 16 engages the crosshead 18. The crosshead 18 transmits the oscillating motion of the rocker arm 16 to the top of the valve assemblies 100, causing at least one valve assembly 100 to open.

FIG. 1 shows the path of oil from the rocker shaft to the crosshead 18. As shown in FIG. 1, oil is introduced into a first set of channels 12 in the rocker shaft and then through a second set of channels 13 in the rocker arm 16 toward a rocker nose 20 portion of the rocker arm 16. As shown in FIG. 1, a restriction 22 is provided in the rocker nose 20 to meter the flow of oil to the crosshead 18. As the rocker arm 16 oscillates (to open and close the valve assemblies 100), oil on the running surfaces of the rocker nose 20 and crosshead 18 splashes around the inside of the valve cover and across surfaces of the crosshead 18. Some of this splashing oil lands on the valve springs 102 of each valve assembly 100 and on valve spring retainers 104 that couple the valve spring 102 to the valve stem 106.

Figure 2:
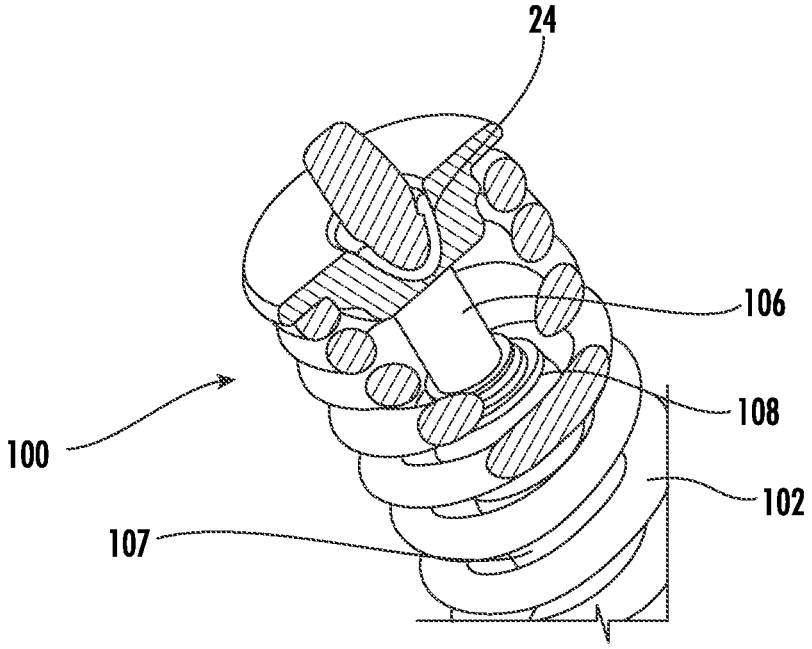
FIG. 2 is a partial view of a spring portion of the overhead valve arrangement of FIG. 1.

The oil is distributed across the valve spring 102 and/or retainer 104 and onto the valve stem 106 and valve stem seal 108 for each valve assembly 100. The valve stem seals 108 meter the quantity of oil allowed to flow down the valve stem to lubricate the valve stem and guide interface between a valve guide 107 and the valve stem 106 (e.g., the valve guide 107 locating and supporting the valve to ensure the valve properly contacts the valve seat within the cylinder head of the engine). As shown in FIG. 2, the valve guide 107 is slidably engaged with the valve stem 106 so that the valve can move through the valve guide 107. A lower end of the valve stem seal 108 is engaged with and coupled to an upper end of the valve guide 107. An upper end of the valve stem seal 108 is slidably and sealingly engaged with the valve stem 106. The valve stem seals 108 require a continuous supply of lubrication to ensure proper operation. As shown in FIG. 2, oil collected on an upper surface of the valve spring retainer 104 runs along the valve stem 106 through axially extending gaps in the valve collets 24 to lubricate the valve stem seals 108. Splashing oil may also find its way through the valve spring 102 to the valve stem seals 108 through gaps in the valve spring 102 as the valve springs 102 compresses and extends.

Figure 3:
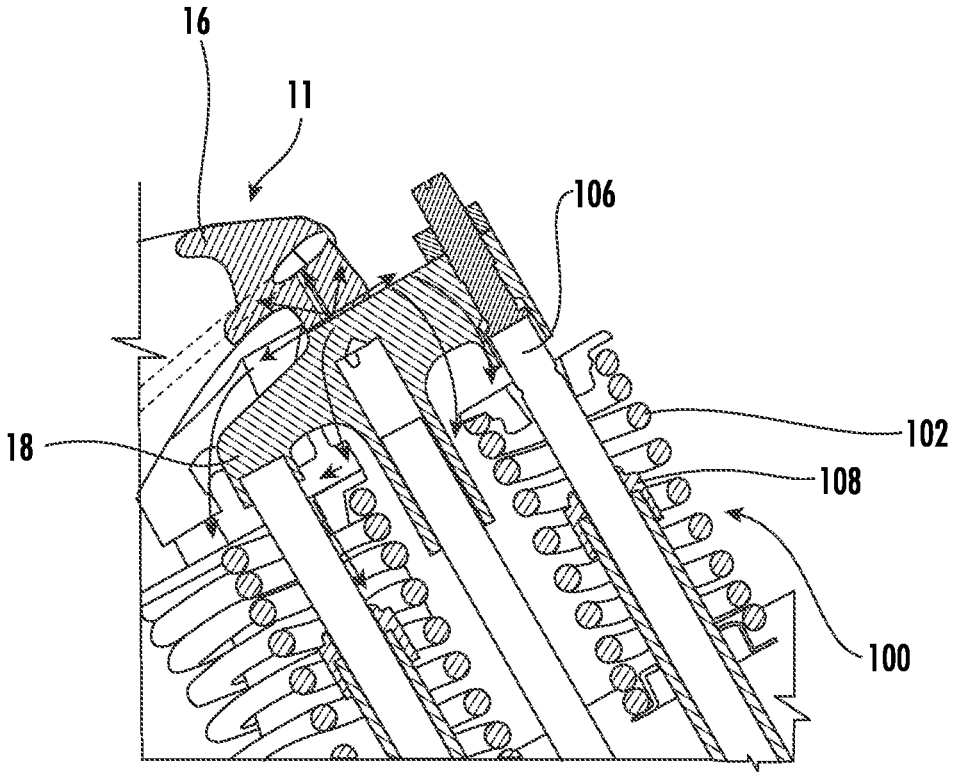
FIG. 3 is another partial view of the overhead valve arrangement of FIG. 1.

As shown in FIGS. 2 and 3, the distribution of oil onto each valve assembly 100 varies depending on the position of the valve assembly 100 within the enclosed space. For example, in the Vee engine structure shown in FIG. 2 (or for an inline engine installed in an angle, or in any configuration in which the cylinder axes are non-vertical), the valve assemblies 100 are positioned along an inclined plane. This arrangement causes certain valve assemblies 100 to receive more oil than others due to gravity acting on the splashing oil. In particular, valve assemblies 100 that are located at a lower position (e.g., low side valve assemblies below the rocker nose 20) receive more oil than valve assemblies 100 that are located at higher, more elevated positioned within the enclosed space (e.g., high side valve assemblies). In other words, gravity promotes oil landing on the surfaces of the crosshead 18 (see FIG. 1) to preferentially fall toward the valve assemblies 100 on a lower end of the enclosed space. This issue is particularly problematic at engine startup (e.g., when the lubrication system is priming), at reduced engine oil temperatures, and during periods of engine operation at idle. Under these operating conditions, the valve speed and oil viscosity limits the amount of lubrication provided to some of the valve assemblies 100, depriving those valve assemblies 100 of oil, and reducing their performance and overall operating life.

The valve spring retainer structure of the present disclosure mitigates the aforementioned lubrication issues by capturing some of the oil during engine operation within a reservoir in the valve spring retainer and redistributing the captured oil onto the valve stem and other parts of the valve assembly in response to movement of the valve. In one embodiment, the valve spring retainer incorporates a reservoir in the form of an open top bowl facing away from the valve spring. The reservoir is formed at an intersection between a radial flange portion of the valve spring retainer and a curved and/or angled re-entrant lip extending radially inwardly from an outer peripheral region of the radial flange. During engine operation, oil distributed onto the valve spring retainer by movement of the rocker arm and crosshead is captured (e.g., trapped, etc.) within the reservoir. This captured oil remains within the reservoir after the engine has been shut down. Upon restarting the engine (e.g., upon actuation of the valve), the oil in the reservoir is flung in the direction of the valve stem by the re-entrant lip as the valve accelerates into an open position, providing splash lubrication to the valve stem seal and other parts of the valve assembly. Among other benefits, improving lubrication of the valve stem seals and other parts of the valve assembly increases the operating life of these components and the uptime of the internal engine combustion system. Moreover, the enhanced lubrication performance relies on movement of the valve to re-distribute the oil, which eliminates the need for separate oil transfer lines/flow tubes to direct flow to each individual valve assembly.

The various concepts introduced above and discussed in greater detail below may be implemented in any of numerous ways, as the described concepts are not limited to any particular manner of implementation. Examples of specific implementations and applications are provided primarily for illustrative purposes.

Various numerical values herein are provided for reference purposes only. Unless otherwise indicated, all numbers expressing quantities of properties, parameters, conditions, and so forth, used in the specification and claims are to be understood as being modified in all instances by the term "approximately." Accordingly, unless indicated to the contrary, the numerical parameters set forth in the following specification and attached claims are approximations. Any numerical parameter should at least be construed in light of the number reported significant digits and by applying ordinary rounding techniques. The term "approximately" when used before a numerical designation, e.g., a quantity and/or an amount including range, indicates approximations which may vary by (+) or (−) 10%, 5%, or 1%.

As will be understood by one of skill in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member.

Figure 4:
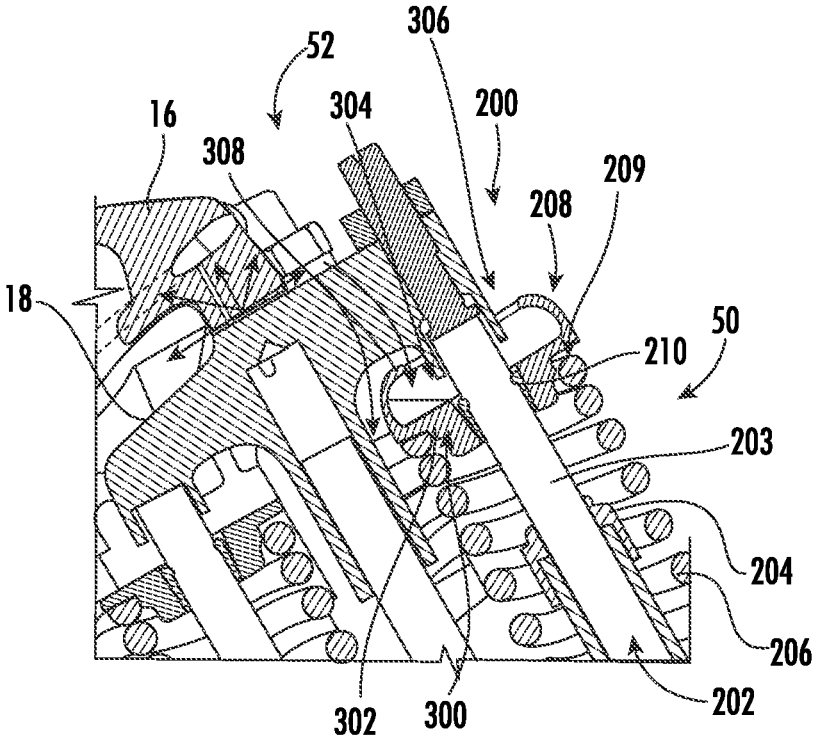
FIG. 4 is a partial view of an overhead valve arrangement for an internal combustion engine system, according to another embodiment.
Figure 5:
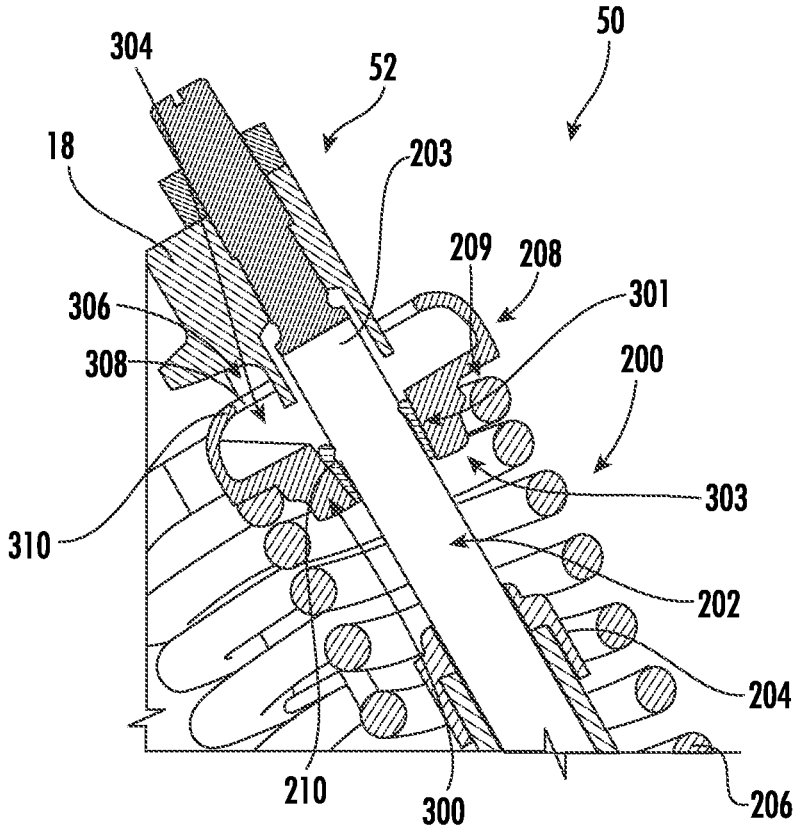
FIG. 5 is a partial view of a valve assembly on a high side of the overhead valve arrangement of FIG. 4.

FIGS. 4-5 show a portion of a valve train 52 for an internal combustion engine system, shown as engine 50, according to at least one embodiment. The engine 50 includes an engine block, shown as cylinder block 26 having cylinders 28 arranged in pairs on either side of the cylinder block 26 in a Vee shaped configuration. The engine 50 may be a diesel engine, a gasoline engine, a natural gas engine, a dual fuel engine, a biodiesel engine, an E85 engine, a flex fuel engine, a gas turbine, or another type of internal combustion engine or driver. In various embodiments, the engine 50 may be a high horse power (HHP) engine, such as, for example, an engine capable of providing power in the range of 500 hp to 4,500 hp or more. The engine 50 may be used to power an electric power generator (e.g., genset, etc.) used to produce electricity (e.g., power), an alternator, or the like. In another embodiment, the engine system 5 may be used to power a truck, a boat, a locomotive, or another type of vehicle (e.g., an on-road or off-road vehicle). In yet another embodiment, the engine system 50 may be used in an industrial application to drive a pump, hydraulic system, or another type of system.

Although concepts of the present disclosure are described with reference to a Vee shaped engine block configuration, embodiments of the present disclosure are not limited to a single engine configuration/design. For example, the same valve assembly configuration and valve spring retainer structure may be used with any other engine configuration including, but not limited to, inline engines that are arranged at an angle, or any engine configuration in which a central axis of one or more cylinders is tilted at an angle (e.g., non-vertical).

FIG. 5 shows a partial view of a single overhead valve assembly 200 of the valve train 52 shown in FIG. 1. The valve assembly 200 may be an inlet valve structured to control the delivery of fresh air into the combustion cylinder, or an outlet valve structured to exhaust gasses from the combustion cylinder and away from the engine 50. In the embodiment of FIG. 5, the valve assembly 200 includes a valve 202, a valve seal 204, a valve spring 206, and a valve spring retainer assembly 208. The valve 202 includes a valve head (see valve head 109 of FIG. 1) and a valve stem 203 (e.g., rod, cylinder, etc.) extending away from the valve head. An outer end of the valve stem 203 is engaged with a crosshead 18 of the valve train 52, which transmits force from the rocker arm 16 to actuate (e.g., open) the valve assembly 200. The valve seal 204 is sealingly engaged with the valve stem 203 and meters the quantity of oil allowed to flow from the valve train 52 down the valve stem to lubricate the valve stem and guide interface.

The valve spring 206 applies a force to the valve stem 203 via the valve spring retainer assembly 208 to return the valve 202 to a closed position. As shown in FIG. 5, the valve spring 206 is positioned around the valve stem 203 between the crosshead 18 and an upper surface of the engine block and/or lower collar (not shown). The valve spring 206 is a helical coil spring that surrounds the valve stem 203. The valve spring retainer assembly 208 positions the valve spring 206 with respect to the valve stem 203 and sets a compression of the valve spring 206 when the valve 202 is in the closed position. As shown in FIG. 5, the valve spring retainer assembly 208 is coupled to the valve stem 203 and is engaged with an outer axial end 209 of the valve spring 206.

The valve spring retainer assembly 208 is positioned between the valve spring 206 and the crosshead 18. The valve spring retainer assembly 208 includes a valve spring retainer 300 and at least one retaining collet 210 engaged with and disposed between the valve spring retainer 300 and the valve stem 203. The collet 210 is structured to fixedly couple the valve spring retainer 300 to the valve stem 203 and to set an axial position of the valve spring retainer 300 along the valve stem 203. The collet 210 is positioned within a first opening 301 (e.g., through-hole opening, etc.) defined by the valve spring retainer 300, at a closed end 303 of the valve spring retainer 300. In at least one embodiment, the retaining collet 210 includes gaps, grooves, and/or channels extending in axial direction (e.g., substantially parallel to the valve stem 203) to allow oil to flow through the collet 210 and onto the valve seal 204 (see also FIG. 2). As shown in FIG. 4, the valve spring retainer assembly 208 is disposed on a high side valve assembly 200, at an elevated position within the enclosed space. In other embodiments, the valve spring retainer assembly 208 may be used on all of the valve assemblies of the valve train 52.

As shown in FIGS. 4-5, the valve spring retainer 300 includes a body 302 that defines an open reservoir 304 that is structured to capture and retain (e.g., store, etc.) a volume of oil therein. An open end 306 of the reservoir 304 faces away from the valve spring 206 and toward the crosshead 18. As shown in FIG. 4, a substantially circular opening, shown as second opening 308 at the open end 306 of the valve spring retainer 300 has a diameter that is larger than an outer diameter of the valve stem 203. The open end 306 of the reservoir 304 is positioned just below the crosshead 18 so as to receive some of the splash oil that is distributed across an upper surface of the crosshead 18 during engine operation.

As shown in FIG. 5, the valve spring retainer 300 also includes a curved re-entrant lip 310. The re-entrant lip 310 forms part of the reservoir 304 and extends radially inward toward the valve stem 203 at the open end 306 of the valve spring retainer 300. During engine operation, the rocker arm 16 (see FIG. 4) drives the crosshead 18 and valve stem 203 toward an open position, in an axial direction (e.g., substantially parallel to an axis of the valve stem 203) toward the combustion cylinder. The acceleration of the valve assembly 200 toward the open position overcomes the acceleration due to gravity, forcing the captured volume of oil upward toward the open end 306 of the valve spring retainer 300 and against the re-entrant lip 310. The re-entrant lip 310 redirects the oil in an at least partially radial direction toward the valve stem 203. From the valve stem 203, the oil may pass through the gaps in the retaining collet 210, and/or between the retaining collet 210 and the valve stem 203 to lubricate the valve seal 204.

Figure 7:
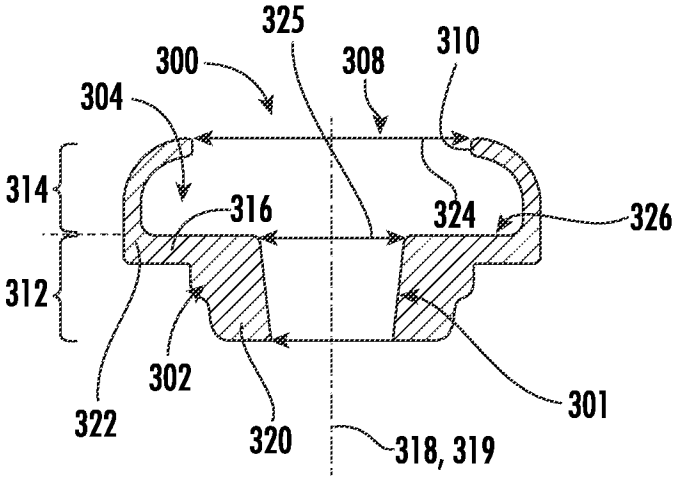
FIG. 7 is a side cross-sectional view of the valve spring retainer of FIG. 6.
Figure 6:
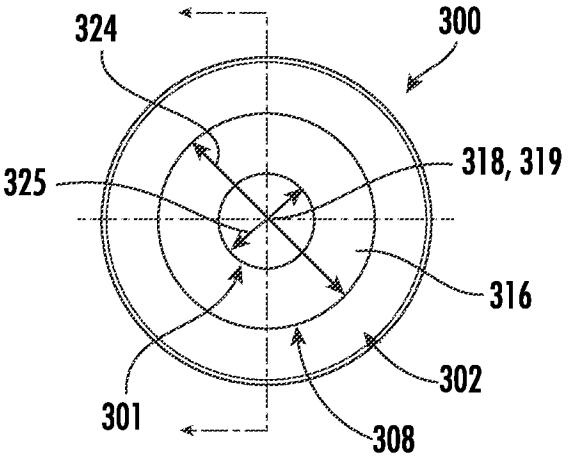
FIG. 6 is a top view of a valve spring retainer, according to an embodiment.
Figure 8:
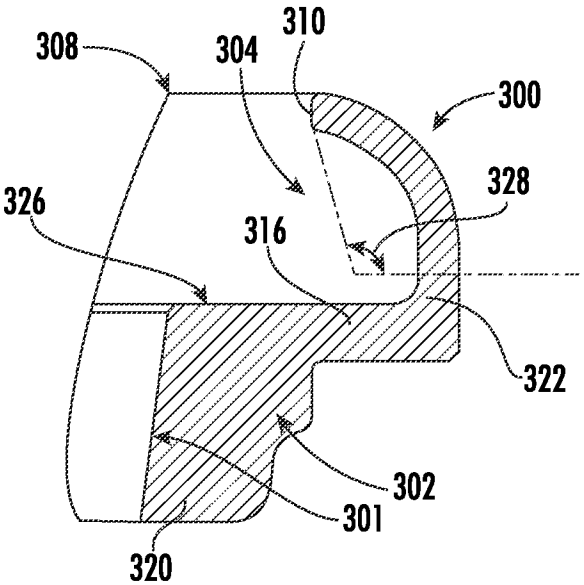
FIG. 8 is a partial side cross-sectional view of the valve spring retainer of FIG. 6.

FIGS. 6-8 show top and side cross-sectional views of the valve spring retainer 300, according to an example embodiment. The valve spring retainer body 302 includes a lower portion 312 (e.g., first portion, etc.) and an upper portion 314 (e.g., second portion, etc.). The lower portion 312 defines a radial flange 316 that is structured to engage with the outer axial end 209 of the valve spring 206 (see also FIGS. 4-5). As shown in FIGS. 6-7, the radial flange 316 extends radially away from a central axis 318 of the body 302 and defines a substantially planar surface that is oriented perpendicular to the central axis 318.

The lower portion 312 defines the first opening 301 that is sized to receive the retaining collet 210 therein (see also FIGS. 4-5). As shown in FIG. 7, the first opening 301 is disposed at a central position along the lower portion 312 and extends axially through the radial flange 316. A central axis 319 of the first opening 301 may be substantially co-linear with a central axis 318 of the body 302. An inner side wall of the first opening 301 is tapered such that the inner diameter of the first opening 301 is smaller at a lower axial end of the lower portion 312 than at an upper axial end of the lower portion 312. The lower portion 312 may also include a protrusion 320 extending axially away from the radial flange 316, from a lower surface of the radial flange 316 to center the valve spring 206 with respect to the lower portion 312. As shown in FIG. 7, the protrusion 320 is substantially coaxial with the radial flange 316.

The upper portion 314 defines the re-entrant lip 310 for the valve spring retainer 300 that slings oil from the reservoir 304 toward the valve stem during valve actuation. As shown in FIGS. 7-8, the upper portion 314 extends at least partially axially away from an outer perimeter edge 322 of the radial flange 316 and radially inward toward the central axis 319 of the first opening 301. An outer end of the upper portion 314 (e.g., re-entrant lip 310) defines the second opening 308, which is positioned in substantially coaxial arrangement with the first opening 301 (e.g., the central axis 319 of the first opening 301 is substantially co-linear with a central axis of the second opening 308). Together, the radial flange 316 and the upper portion 314 define the open reservoir 304. As shown in FIGS. 6-7, an inner diameter 324 of the second opening 308 is greater than a maximum inner diameter 325 of the first opening 301 so as to provide a radial gap through which splashing oil can enter the reservoir 304. In other embodiments, the second opening 308 may form an elliptical shape or another suitable shape to maximize the capture of splashing oil.

In the embodiment of FIGS. 6-8, the upper portion 314 is a curved (e.g., arcuate) wall. A first end (e.g., lower end) of the curved wall extends axially away from the radial flange 316, in substantially perpendicular orientation relative to an upper surface 326 of the radial flange 316. The upper portion 314 curves radially inward toward the central axis 319 of the first opening 301 between the first end and the re-entrant lip 310. The curved wall may have an approximately constant radius of curvature to smooth the transition between the curved wall and the re-entrant lip 310 and help sling the captured oil toward the valve stem 203.

Figure 9:
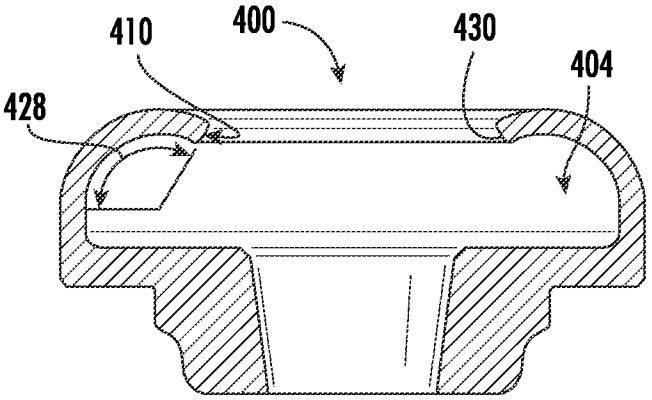
FIG. 9 is a side cross-sectional view of a valve spring retainer, according to another embodiment.

The lubrication performance of the valve spring retainer 300 will vary depending on the geometry of the upper portion 314. In the embodiment of FIG. 8, the curved wall extends across an angle 328 of approximately 85° to the outer edge (e.g., re-entrant lip 310). However, the geometry of the curved wall shown and described with reference to FIGS. 6-8 should not be considered limiting. In various embodiments, the curved wall extends across an angle within a range between approximately 60° and 120° from the upper surface 326 of the radial flange 316, or another suitable angle. For example, FIG. 9 shows a valve spring retainer 400 having a curved wall that extends across an angle 428 of approximately 120° from an upper surface of the radial flange, such that an outer edge 430 of the curved wall (e.g., re-entrant lip 410) curves back (e.g., axially) toward the upper surface of the radial flange. The hooked outer edge 430 of the re-entrant lip 410 helps prevent captured oil from escaping the reservoir 404 through the open end of the reservoir 404 during actuation of the valve assembly.

Figure 10:
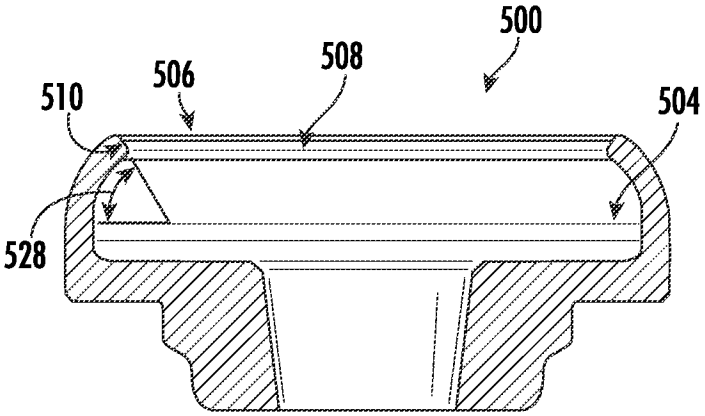
FIG. 10 is a side cross-sectional view of a valve spring retainer, according to another embodiment.

FIG. 10 shows a valve spring retainer 500 having a re-entrant lip 510 that extends across an angle 528 of approximately 60° from an upper surface of the radial flange. Among other benefits, the design of the valve spring retainer 500 shown in FIG. 10 facilitates capture of splashing oil from the crosshead, due to the larger second opening 508 at the open end 506 of the reservoir 504.

Figure 11:
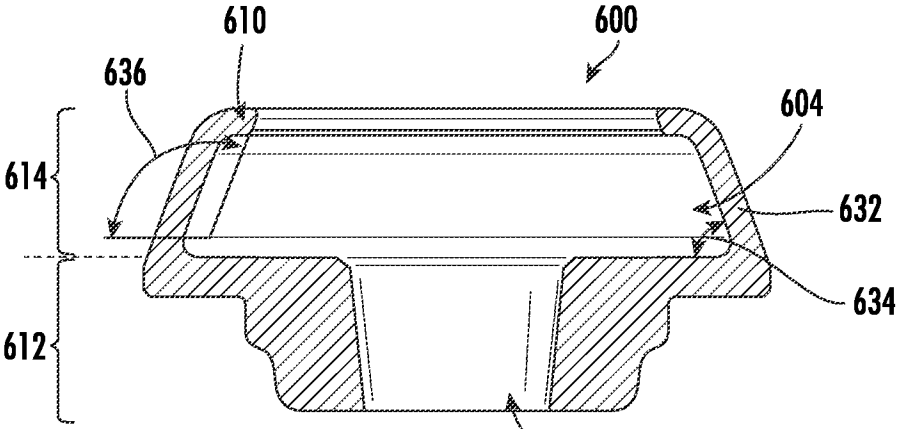
FIG. 11 is a side cross-sectional view of a valve spring retainer, according to another embodiment.

The design of the upper portion of the valve spring retainer is not limited to curved and/or cylindrical walls. For example, FIG. 11 shows yet another embodiment of a valve spring retainer 600 for an intake/exhaust valve assembly in which the upper portion 614 includes both straight and curved sections. A lower portion 612 of the valve spring retainer 600 is the same as or similar to the lower portion 312 described with reference to FIGS. 6-8. An upper portion 614 of the valve spring retainer 600 includes a conical extension 632 that extends axially away from an outer perimeter edge of the radial flange and at least partially radially inward toward a central axis of the first opening 601. The conical extension 632 forms an angle 634 of approximately 70° with respect to an upper surface of the radial flange. The upper portion 614 additionally includes a curved re-entrant lip 610 extending radially inward from an outer end of the conical extension 632. In the embodiment of FIG. 11, an inner radial surface of the re-entrant lip 610 forms an angle 636 of approximately 110° with respect to the upper surface of the radial flange. The conical extension 632 and the radial flange together form a conical oil receiving bowl 604. In other embodiments, the angles 634, 636 of the conical extension 632 and re-entrant lip 610 may be different.

Figure 12:
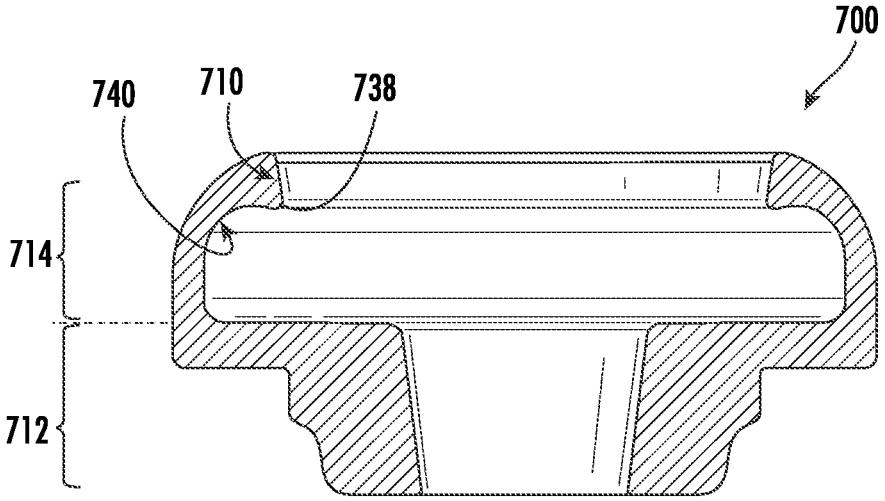
FIG. 12 is a side cross-sectional view of a valve spring retainer, according to another embodiment.

FIG. 12 shows yet another embodiment of a valve spring retainer 700 for an intake/exhaust valve assembly. The valve spring retainer 700 is similar to the valve spring retainer 300 described with reference to FIGS. 6-8, but also includes a lower protrusion 738 extending downwardly (e.g., axially away from) from the re-entrant lip 710, such that a thickness of the upper portion 714 at the re-entrant lip 710 is greater than a thickness at a first end of the upper portion 714 (i.e., a first end where the upper portion 714 is engaged with the radial flange). The lower protrusion 738 and the curved wall together define a smooth inner surface 740 having a first radius along the curved wall before the protrusion 738, and a second radius where the curved wall meets with the protrusion 738 that is less than the first radius. In other embodiments, the inner surface 740 may be discontinuous where the curved wall meets with the protrusion 738 (e.g., the inner surfaces may intersect at sharp transition or angle).

Figure 13:
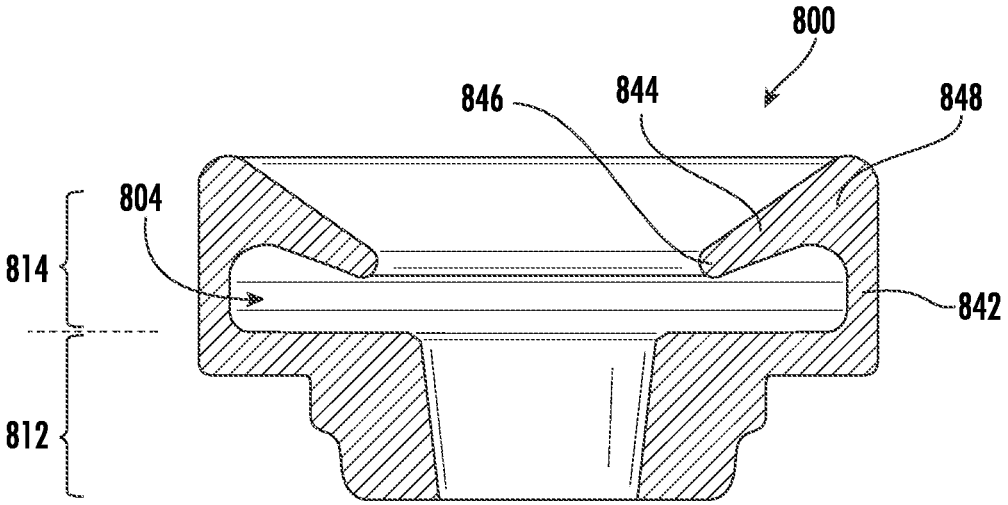
FIG. 13 is a side cross-sectional view of a valve spring retainer, according to another embodiment.

FIG. 13 shows yet another embodiment of a valve spring retainer 800 for an intake/exhaust valve assembly. Again, a lower portion 812 of the valve spring retainer 800 is the same as the lower portion 312 of the valve spring retainer 300 described with reference to FIGS. 6-8. An upper portion 814 of the valve spring retainer 800 includes a first wall 842 extending axially away from an outer perimeter of the radial flange and a second wall 844 extending at least partially radially inwardly from distal end of the first wall 842. As shown in FIG. 13, the second wall 844 forms a conically-shaped extension. The conically-shaped extension is angled in an axial direction such that a distal end 846 of the second wall 844 is closer to an upper surface of the radial flange than a proximal end 848 of the second wall 844 (e.g., a proximal end 848 at which the second wall 844 engages the first wall 842). The second wall 844 forms a funnel that extends toward the open reservoir 804 of the valve spring retainer 800. Any oil landing on an outer surface of the second wall 844 will be directed into the open reservoir 804 formed between the radial flange, the first wall 842, and the second wall 844. The angle formed between the first wall 842 and the second wall 844 may be different in various embodiments.

Figure 14:
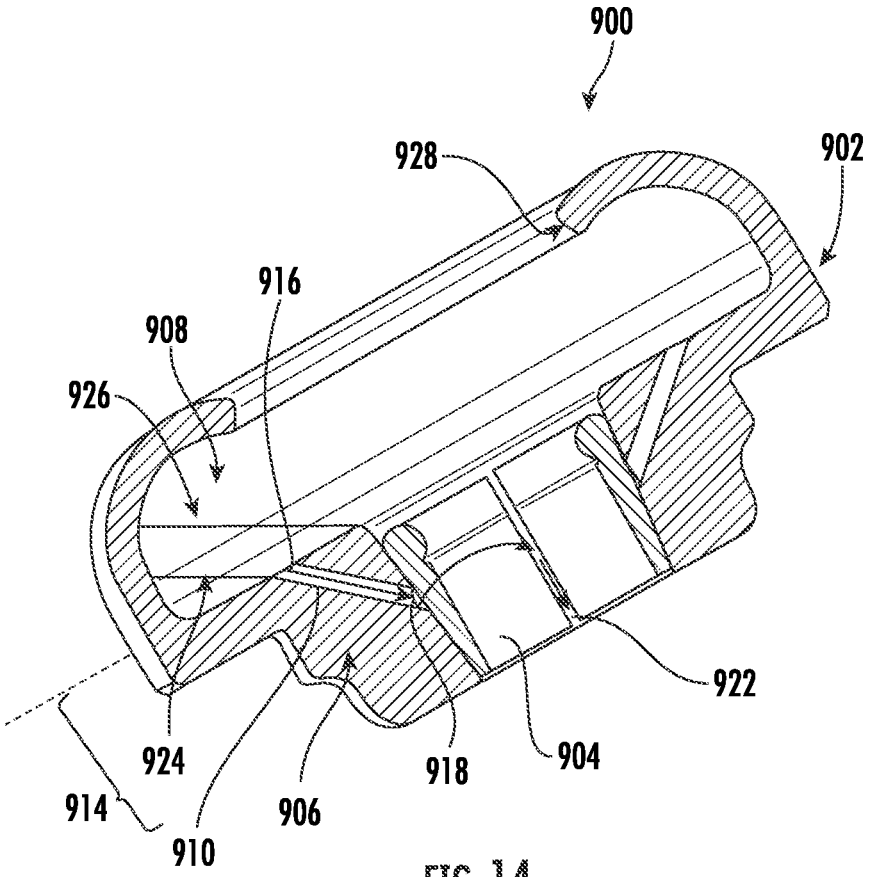
FIG. 14 is a side cross-sectional view of a valve spring retainer assembly, according to an embodiment.
Figure 15:
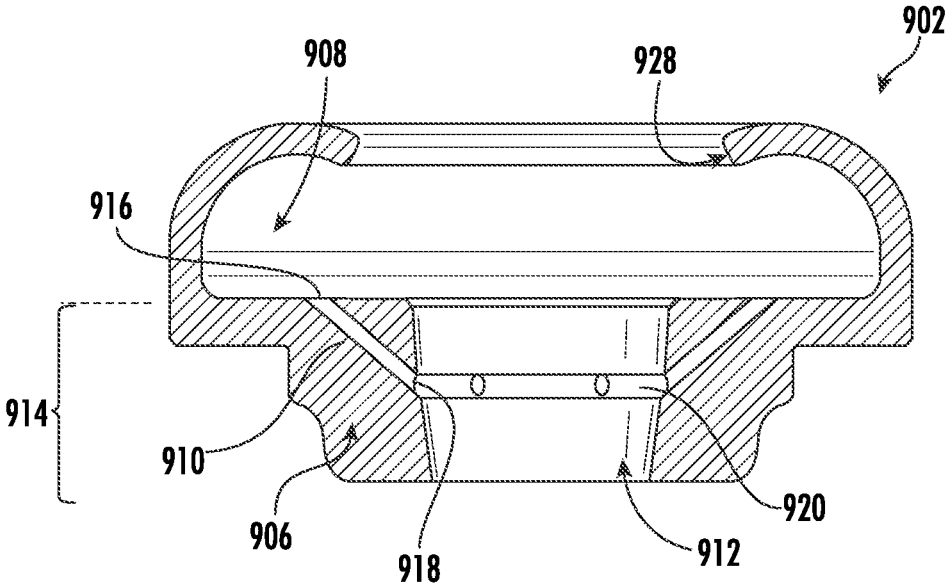
FIG. 15 is a side cross-sectional view of a valve spring retainer of the valve spring retainer assembly of FIG. 14.

FIGS. 14-15 show cross-sectional views of a valve spring retainer assembly 900 according to another example embodiment. The valve spring retainer assembly 900 includes a valve spring retainer 902 and a retaining collet 904 that is structured to couple the valve spring retainer 902 to a valve stem. The valve spring retainer 902 is similar to the valve spring retainer 400 described with reference to FIG. 9, but also includes channels and/or grooves in the body 906 of the valve spring retainer 902 to facilitate the transfer of captured oil directly from the reservoir 908 to the valve seal. As shown in FIG. 15, the valve spring retainer 902 includes at least one channel 910 that extends at an angle between the reservoir 908 and a first opening 912 in the valve spring retainer 902. More specifically, the channel 910 extends from an upper surface of the radial flange, through the lower portion 914 of the valve spring retainer 902, axially downward and radially inward toward the first opening 912. An opening 916 at a first end of the channel 910 is disposed at an intermediate radial position between in the upper surface of the radial flange. An opening 918 at a second end of the channel 910 is disposed along an inner surface of the first opening 912. As shown in FIG. 15, the channel 910 is fluidly coupled to a groove 920 that extends circumferentially along the inner surface of the first opening 912. As shown in FIG. 14, the channel 910 and the groove 920 direct oil from an upper portion of the reservoir 908 to axially extending gaps 922 (e.g., voids, spaces, etc.) in the retaining collet 904.

As shown in FIG. 14, the channels 910 allow for transfer of oil directly from the reservoir 908 toward the valve stem and valve seal. Any captured oil above a storage threshold within the reservoir 908 (e.g., between a lower oil level line 924 and a high oil level line 926) will drain from the reservoir 908 through the channels 910. Among other benefits, the combination of the channels 910 and the re-entrant lip 928 improve oil transfer from the reservoir 908 to the valve seal as compared to the re-entrant lip 928 acting on its own.

Figure 16:
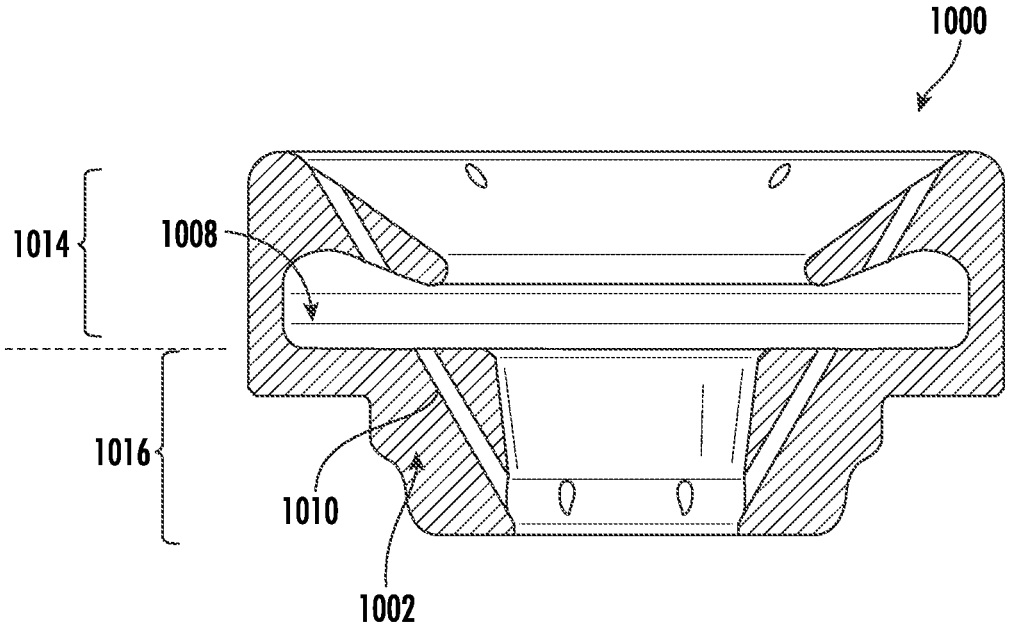
FIG. 16 is a side cross-sectional view of a valve spring retainer, according to another embodiment.

The number, size, position, and shape of the channels 910 and/or groove 920 may be different in various embodiments. For example, FIG. 16 shows an embodiment of a valve spring retainer 1000 that is similar to the valve spring retainer 800 described with reference to FIG. 13. As shown in FIG. 16, the valve spring retainer 1000 includes channels 1010 that extend through both an upper portion 1014 and a lower portion 1016 of the valve spring retainer body 1002. In particular, the channels 1010 extend through a second wall section of the upper portion 1014. Beneficially, the channels 1010 provide a second flow path for oil landing on the outer surface of the upper portion 1014 to enter the reservoir 1008. In another embodiment, the portion of the channel 1010 extending through the second wall section may have a different geometry from the portion of the channel 1010 that extends through the lower portion 1016. In yet another embodiment, the number of channels 1010 extending through the lower portion 1016 may be different from the number of channels 1010 extending through the upper portion 1014.

Figure 17:
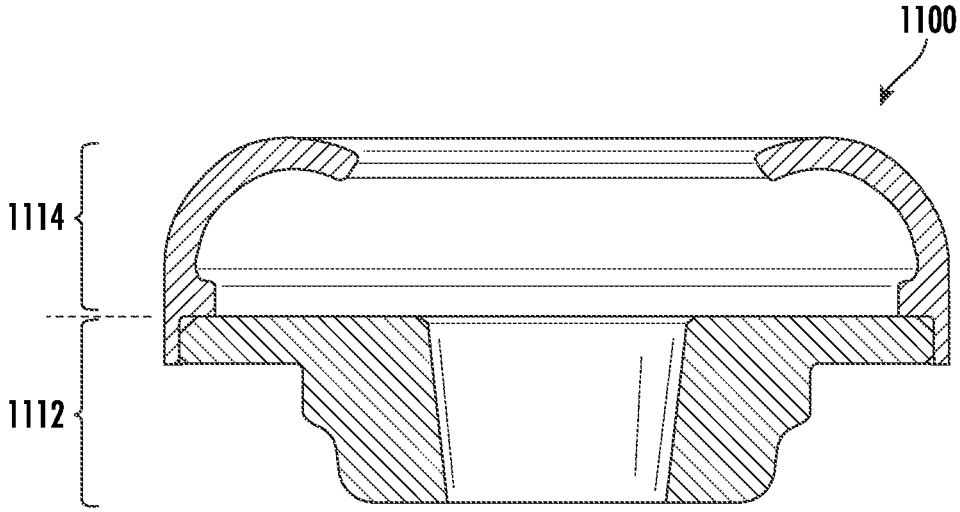
FIG. 17 is a side cross-sectional view of a multi piece valve spring retainer, according to an embodiment.

The valve spring retainers described with reference to FIGS. 4-16 may be formed from a variety of materials. For example, the valve spring retainers may be forged, machined, or otherwise formed as a single unitary piece from heat treated carbon steel, or another suitable material. In another embodiment, the valve spring retainers may be made from multiple pieces of material that are coupled together. For example, FIG. 17 shows a two-piece valve spring retainer 1100 in which the upper portion 1114 is formed separately from the lower portion 1112, according to an embodiment. The lower portion 1112 may be a forged and/or machined from a solid piece of steel, or another suitable material. The upper portion 1114, which forms the re-entrant lip and reservoir for the valve spring retainer 1100, may be forged or otherwise formed separately from the lower portion 1112. The upper portion 1114 does not need to have the same structural material properties as the lower portion 1112 and thus may be formed from a separate material as the lower portion 1112. For example, the upper portion 1114 may be formed from an injection molded plastic, rubber, aluminum, or another suitable material. The upper portion 1114 may be coupled to the lower portion via press fit, shrink fit, welding, bonding (e.g., using a suitable adhesive product), threading, swaging, and/or another suitable joining operation. In one embodiment, the upper portion 1114 may be structured to retrofit an existing valve spring retainer, which allows for the re-use of valve spring retainers that are already installed on an engine.

It should be noted that the term "example" as used herein to describe various embodiments is intended to indicate that such embodiments are possible examples, representations, and/or illustrations of possible embodiments (and such term is not intended to connote that such embodiments are necessarily extraordinary or superlative examples).

As utilized herein, the term "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed (e.g., within plus or minus five percent of a given angle or other value) are considered to be within the scope of the invention as recited in the appended claims.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Other substitutions, modifications, changes and omissions may also be made in the design, operating conditions and arrangement of the various exemplary embodiments without departing from the scope of the embodiments described herein.

While this specification contains many specific implementation details, these should not be construed as limitations on the scope of any embodiment or of what may be claimed, but rather as descriptions of features specific to particular implementations of particular embodiments. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A valve spring retainer, comprising:
- a body comprising:
  - a lower portion including a radial flange with an axially extending first opening; and
  - an upper portion comprising:
    - a circumferential wall extending axially away from an outer perimeter edge of the radial flange; and
    - an open reservoir defined by the circumferential wall and the radial flange,
    - wherein a distal end of the circumferential wall curves radially inward toward a central axis of the first opening so as to form a re-entrant lip that partially covers the reservoir.

2. The valve spring retainer of claim 1, wherein an end surface of the re-entrant lip defines a second opening that is substantially coaxial with the first opening.

3. The valve spring retainer of claim 2, wherein a diameter of the second opening is greater than a diameter of the first opening.

4. The valve spring retainer of claim 1, wherein an end surface of the re-entrant lip forms an angle of approximately 60° to 120° with respect to the radial flange.

5. The valve spring retainer of claim 1, wherein the upper portion further comprises a lower protrusion extending axially inward from the re-entrant lip.

6. The valve spring retainer of claim 1, wherein the circumferential wall is formed as a conical extension that tapers inward toward the central axis.

7. The valve spring retainer of claim 1, wherein the re-entrant lip is formed as a conically-shaped extension that extends radially and axially inward from the circumferential wall.

8. The valve spring retainer of claim 1, wherein the lower portion defines a channel extending at an angle from the reservoir to an inner radial surface of the first opening.

9. The valve spring retainer of claim 1, wherein the upper portion is made from a different material than the lower portion.

10. The valve spring retainer of claim 1, wherein the lower portion further includes a protrusion extending axially away from a lower surface of the radial flange, and wherein the protrusion is substantially coaxial with the radial flange.

11. The valve spring retainer of claim 1, wherein the distal end of the circumferential wall has a constant radius of curvature.

12. A valve assembly, comprising:
- a valve comprising a valve head and a valve stem extending away from the valve head;
- a valve spring disposed around the valve stem; and
- a retainer coupled to the valve stem and engaged with an end of the valve spring, the retainer comprising a circumferential wall defining a reservoir with an open end facing away from the valve spring, wherein a distal end of the circumferential wall curves radially inward toward a central axis of the retainer so as to form a re-entrant lip that partially covers the reservoir.

13. The valve assembly of claim 12, further comprising:
- a pair of collets disposed between the retainer and the valve stem, the pair of collets configured to couple the retainer to the valve stem; and
- a valve guide disposed around the valve stem, the valve guide configured to slidably engage the valve stem.

14. The valve assembly of claim 12, wherein the retainer further comprises a radial flange defining an axially extending first opening, wherein an end surface of the re-entrant lip defines a second opening that is substantially coaxial with the first opening, and wherein a diameter of the second opening is greater than a diameter of the first opening.

15. The valve assembly of claim 12, wherein the retainer further comprises a radial flange including an outer perimeter edge from which the circumferential wall extends, and wherein the circumferential wall is formed as a conical extension that tapers inward toward the central axis.

16. The valve assembly of claim 12, wherein the retainer further comprises a radial flange including an outer perimeter from which the circumferential wall extends, and wherein the re-entrant lip is formed as a conically-shaped extension that extends radially and axially inward from the circumferential wall.

17. The valve assembly of claim 12, wherein the retainer further comprises;

an inner radial surface defining a first opening; and a channel extending at an angle from the reservoir to the first opening.

18. An engine, comprising:

a cylinder block including a plurality of cylinders; and a valve assembly comprising:

a valve configured to control delivery of fresh air into a first cylinder of the plurality of cylinders;

a valve spring at least partially surrounding the valve; and a retainer coupling the valve spring to the valve, the retainer comprising a circumferential wall defining a reservoir with an open end facing away from the valve spring, wherein a distal end of the circumferential wall curves radially inward toward a central axis of the retainer so as to form a re-entrant lip that partially covers the reservoir.

19. The engine of claim 18, wherein the retainer further comprises a radial flange defining an axially extending first opening, wherein an end surface of the re-entrant lip defines a second opening that is substantially coaxial with the first opening, and wherein a diameter of the second opening is greater than a diameter of the first opening.

20. The engine of claim 18, wherein the retainer further comprises:

an inner radial surface defining a first opening; and a channel extending at an angle from the reservoir to the first opening.

* * * * *